United States Patent [19]

Siwon

[11] Patent Number: 4,463,877

[45] Date of Patent: Aug. 7, 1984

[54] DEVICE FOR GUIDING A ROD-SHAPED MEMBER FORMED OF A GLUING MATERIAL WHICH CAN BE SOFTENED BY HEAT

[75] Inventor: Hans Siwon, Obing, Fed. Rep. of Germany

[73] Assignee: Steinel GmbH & Co. K.G., Herzebrock, Fed. Rep. of Germany

[21] Appl. No.: 428,219

[22] Filed: Sep. 29, 1982

[30] Foreign Application Priority Data

Oct. 26, 1981 [DE] Fed. Rep. of Germany ..... 3142363

[51] Int. Cl.[3] ..... B67D 5/62

[52] U.S. Cl. ..... 222/146 HE; 219/230; 285/41; 285/236; 165/47; 165/185

[58] Field of Search ..... 222/146 HE, 146 H; 219/230, 421; 425/12, 87, 378 R; 285/41, 236; 165/47, 185

[56] References Cited

U.S. PATENT DOCUMENTS 927,635 7/1909 Calvert ..... 285/236
1,449,517 3/1923 Lame ..... 222/146 H
3,430,816 5/1969 Nadherny et al. .
4,314,655 2/1982 Leibhard et al. ..... 222/146 HE
4,352,442 10/1982 Leibhard et al. ..... 219/422

FOREIGN PATENT DOCUMENTS 1249738 9/1967 Fed. Rep. of Germany .

*Primary Examiner*—H. Grant Skaggs
*Attorney, Agent, or Firm*—Louis Weinstein

[57] ABSTRACT

A device for guiding a rod-shaped member formed of a gluing material which is softened by heat through insertion into a guide channel of a heating apparatus, the device comprising an elastic, flexible cartridge arranged on a heater and secured thereto by a metal sleeve. The metal sleeve extends beyond the heater and surrounds a portion of the cartridge for conducting heat to a section of the cartridge removed from the heater. A small gap is provided between the cartridge and the portion of the metal sleeve surrounding the cartridge to allow for an enlargement in cartridge diameter. The hollow interior of the cartridge is provided with an inwardly directed lip-shaped circumferential edge which cooperates with an inserted gluing material rod to form a seal therebetween. The metal sleeve is preferably a helically coiled metal wire.

11 Claims, 1 Drawing Figure

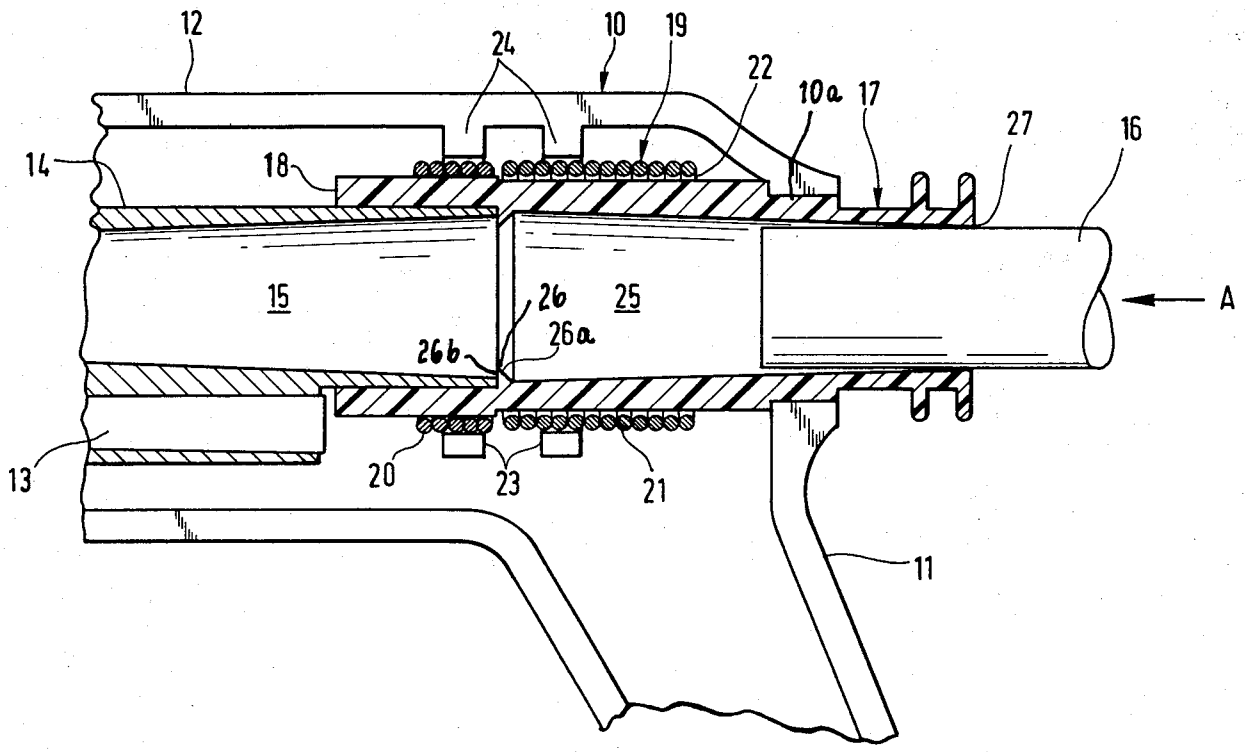
A
16
27
17
10a
22
19
10
24
12
14
18
15
25
26
26a
26b
21
23
20
11
13

DEVICE FOR GUIDING A ROD-SHAPED MEMBER FORMED OF A GLUING MATERIAL WHICH CAN BE SOFTENED BY HEAT

FIELD OF THE INVENTION

The present invention relates to a glue softening apparatus and more particularly to novel glue softening apparatus employing an elastic flexible cartridge and metal sleeve securing the cartridge to a heater and providing an ancillary heating function in a portion of the cartridge.

BACKGROUND OF THE INVENTION

The present inventions concerns a device for guiding a rod-shaped member formed of a material adapted to be softened upon the application of heat when inserted into the guide channel of a heating apparatus which includes an elastic flexible cartridge having one end attached to the guide channel of the heating apparatus.

A capability of the type described above is required, for example, in devices commonly referred to as gluing guns which heat and soften an inserted rod formed of a gluing material. The apparatus typically utilizes electric heating apparatus which heats the rod to convert the gluing material into a liquid which is dispensed through a suitable discharge opening. To achieve this objective, the rod of gluing material is inserted into an elastic flexible cartridge and is fed therethrough either by mechanical apparatus or by manual pressure, in order to enter into the heating apparatus for liquifying the gluing material by heating.

The cartridge which receives the gluing material rod is preferably elastic and flexible, on the one hand, the gluing material rod has certain tolerances in thickness, and on the other hand, an easy insertion of the gluing material should be possible without the exertion of great care with regard to alignment of the rod when inserted into the cartridge. An elastic flexible cartridge facilitates insertion of the gluing material rod with the minimal amount of twisting and precisely and accurately guides the rod into the heater cavity.

Previous cartridges of this type, which are conventionally provided with a cylindrical-shaped channel opening have a number of disadvantages which can be traced back to various causes. For example, the cylindrical insertion channel which surrounds the gluing material rod applies a uniform surface friction over the entire surface of the engaging rod and cylindrical channel of the cartridge with the magnitude of the surface friction being directly related to the size of the surface area. Due to the surface friction, a relatively large force is required in order to advance the gluing material rod through the elastic cartridge into the heater. In addition, glue which has been liquified by the heater can flow back from the heater and enter into the space between the cartridge and the gluing material rod, in the event that the outer diameter of the rod is less than the inner diameter of the cartridge channel, thus leading to the possibility that the liquified glue can flow all the way to the insertion opening of the cartridge. Cooling of the liquified gluing material as it flows out of the heater and back into the cartridge will also cause an enlargement of the diameter of the portion of the gluing material rod which is yet to be advanced into the heater which leads again to an impairment of conventional gluing guns.

BRIEF DESCRIPTION OF THE INVENTION

The present invention solves the task of forming a device which facilitates insertion of a gluing material rod so that the application of only a relatively small pushing force of a backflow of the liquified gluing material is substantially eliminated and rapid cooling of small amounts of the gluing material flowing from the heater back into the cartridge is eliminated.

The above objectives are achieved in a gluing gun of the previously described type, and in accordance with the teachings of the present invention, through the employment of a metal sleeve for supporting the cartridge to the heating unit and having an additional section which encircles a portion of the cartridge removed from the heater.

The aforementioned metal sleeve, which secures the cartridge to the exterior of the heater, provides a rigid, dependable attachment of the cartridge upon the heater, as well as conducting heat from the heater through the metal sleeve to the cartridge which achieves an important objective to be more fully described hereinbelow.

The metal sleeve extends beyond one end of the heater and surrounds a portion of the cartridge removed from the heater. Thus, heat transfer is obtained in a region of the cartridge where an undesired flow of liquid gluing material can occur, for example, in a case where the gluing material rod inserted in the cartridge has a smaller outer diameter than the inner diameter of the cartridge channel. The heat transfer in this region heats the cartridge material resulting in a slow cooling of the liquid gluing material flowing from the heater to the cartridge, thereby preventing an unnecessarily large increase in diameter of the gluing material rod positioned in the cartridge.

The frictional resistance imparted to the gluing material rod by the cartridge channel is kept to a minimum and is independent of enlargements of the diameter of the gluing material since an increase in the diameter of the gluing material is eliminated due to the heat conducted to the cartridge by the aforementioned metal sleeve. On the other hand, the cartridge material is maintained at a higher temperature, enabling it to accommodate a larger diameter gluing material rod and, as a result, the cartridge imparts a relatively small surface friction upon the gluing material rod.

The previously described effect obtained with the apparatus of the present invention is further improved by providing the cartridge with an inwardly directed lip-shaped circumferential edge which forms a seal with the inserted rod-shaped gluing material. The aforementioned edge which is in close proximity to the heater penetrates the already softened gluing material preventing a backflow of liquified gluing material from the heater into the cartridge. If previously liquified gluing material should nevertheless flow ffrom the heater to the cartridge, for example, due to fast insertion of a gluing material rod, premature solidification within the cartridge is eliminated or, at least, significantly retarded.

A further novel feature of the present invention is to arrange the portion of the metal sleeve surrounding the cartridge with an inner diameter which forms a clearance gap with the cartridge. With this arrangement, in the event that a backflow of the gluing material occurs, and the liquid gluing material hardens, for example, through non-use of the heating apparatus, an increase in the diameter of the cartridge containing the gluing material may occur. However, this enlargement is limited by the metal sleeve when engaged by the enlarging cartridge. In addition, the engagement between the cartridge and the metal sleeve provides an even better heat transfer into the cartridge material upon energization of the heater and is especially obtained where the enlargement in the gluing material rod is due to the backward flow of liquid gluing material from the heater into the cartridge and subsequent cooling and solidification of the gluing material on the portion of the rod yet to be fed into the heater. Trouble-free operation due to the aforementioned feature is now possible, even, for example, when the previously described circumferential lip-shaped seal is defective, or is not present.

The aforementioned metal sleeve is preferably a helically-wound wire coil. On the one hand, this allows for an easy installation of the cartridge upon the heater, the wire coil reliably holding the cartridge thereto due to its resilient spring characteristic. On the other hand, the wire coil does not impair the flexibility of the cartridge which is desired to be as unimpeded as possible to facilitate insertion of a gluing material rod.

The metal sleeve in the form of a wire coil is especially useful for providing a clearance between the cartridge and the metal sleeve, either through a reduction in the outside diameter of the cartridge, or an increase in the inside diameter of the portion of the metal sleeve surrounding that portion of the cartridge which is removed from the heater. However, the reduction in the outside diameter of the cartridge reduces the manufacturing cost for the metal sleeve, independent of its construction as a tube-shaped element or as a wire coil.

A further feature of the present invention resides in the fact that the wire coil forming the metal sleeve portion provides a gap space around the outside diameter reduction of the cartridge while the rest of the coil has windings engaging the cartridge. This gap space resists the transfer of heat from the windings to the cartridge. The windings provide heat transfer between the section seated upon the heater and the free section of the cartridge which is so large that a heat-up and liquification of the gluing material rod may occur too rapidly. Through adjustment of the clearance space between the windings and the cartridge in the area of the outside diameter reduction, adjustment of the amount of heat transferred from the free portion of the heater to the cartridge can be controlled.

The hollow interior channel of the cartridge has a tapered conical shape so that its inner diameter increases in the direction of the heater. This provides a further reduction in the frictional force applied to the gluing material rod by the interior wall of the cartridge. The conical enlargement is especially advantageous when incorporated in a cartridge employing a lip-shaped circumferential sealing edge.

OBJECTS OF THE INVENTION AND BRIEF DESCRIPTION OF THE DRAWING

It is therefore one object of the present invention to provide a novel arrangement for use in gluing guns wherein a flexible, elastic cartridge for guiding a gluing material rod into the heater of a gluing gun is secured to one end of the heater and further provides ancillary heating of at least a portion of the cartridge removed from the heater.

Still another object of the present invention is to provide a flexible, elastic cartridge for guiding a gluing material rod into a heater, which cartridge is provided with a lip-shaped circumferential sealing edge for substantially eliminating the backflow of liquified gluing material from the heater to the cartridge.

Still another object of the present invention is to provide apparatus for use in a gluing gun, including a cartridge for guiding a gluing material rod into the gluing gun heater, which cartridge is secured to one end of the heater by a suitable metal sleeve and having an additional portion thereof encircling a portion of the cartridge removed from the heater with a suitable clearance gap to permit some enlargement of the cartridge due to irregularities in the outer diameter of the gluing material rod and further controlling the amount of heat transferred from the metal sleeve to the cartridge.

Still another object of the present invention is to provide novel apparatus for use in a gluing gun comprised of a cartridge for guiding a gluing material rod into the gluing gun heater and having a tapered interior guideway which gradually enlarges as it approaches the entry end of the heater to facilitate insertion of an accommodation for irregularities in the gluing material rod.

The above, as well as other objects of the present invention, will become apparent when reading the accompanying description and drawing in which the sole FIGURE shows a sectional view of the pertinent components of the gluing gun sufficient to convey an adequate understanding of the present invention.

DETAILED DESCRIPTION OF THE INVENTION

The gluing gun is comprised of a pistol-shaped housing, one housing shell half 10 being shown in the FIGURE. Shell half 10 may, for example, be manufactured from a suitable plastic material employing an injection molding process. Shell half 10 is comprised of a grip portion 11 extending substantially diagonally downward from a hollow annular portion 12 which extends from right to left, as shown in the FIGURE. The grip portion 11 is designed to accommodate an electrical conductor (not shown for purposes of simplicity) which connects electrical heating element 13 to a suitable power source such as, for example, an AC power source available through connection with a conventional wall socket. The heating element 13 is preferably an electrical heating resistor which serves to heat a heater unit 14 preferably formed of aluminum which may also be manufactured through the use of an injection molding process. Heater 14 has a conical-shaped guide channel 15 which narrows from right to left. A gluing material rod inserted therein is heated, softened and liquifies. It is ultimately discharged in liquid form through a suitable outlet or nozzle device which has been omitted from the FIGURE for purposes of simplicity. The outlet devices employed in conventional gluing guns may be utilized for this purpose.

A portion of a gluing material rod 16 is shown in the FIGURE and has its left-hand end inserted into elastic flexible cartridge 17. The rod 16 is advanced into cartridge 17 by application of either a mechanical or manual force to move the rod 16 in the direction shown by arrow A. The left-hand end 18 of cartridge 17 has an enlarged inner diameter for being slipped over and hence telescopingly receiving the right-hand end of heater 14. Preferably the inner diameter of the left-hand end 18 of cartridge 17 and the outer diameter of the right-hand end of heater 14 are chosen to provide a substantially good sliding fit, as is shown in the FIG- URE. The left-hand end 18 of elastic flexible cartridge 17 is secured to heater 14 by section 20 of a helical metal wire coil 19. Coil section 20 seals and holds the left-hand end of cartridge 18 upon heater 14 due to the winding directing action of its spring force. Section 21 of coil 19 surrounds at least a portion of the cartridge 17 removed from heater 14 and forms a clearance space 22 therebetween.

The heater 14, cartridge 17 and metal sleeve 19 are joined together in a manner described hereinabove and inserted as a unit into shell half 10 which is provided with projections 23 and 24, for example, as well as semi-circular opening 10*a*, for maintaining said unit in place within shell half 10.

The internal guide channel 25 of cartridge 17 has a conical shape and gradually increases in diameter from right to left. The conical shaped guide channel 25 terminates at a lip-shaped inwardly directed circumferential sealing edge 26 which tapers inwardly from the point where it joins guide channel 25 along the truncated conical surface portion 26*a* which terminates in edge 26. The opposite surface 26*b* forms a shoulder which controls the insertion depth of heater 14 into cartridge 17. The conical-shaped guide channel 25 limits the amount of frictional drag imposed upon gluing material rod 16 by cartridge 17 to the immediate region of entrance opening 27 of the cartridge 17.

Due to the excellent heat transfer characteristic of the metal wire coil 19, the coil, in addition to providing mechanical securement of cartridge 18 to heater 14, further provides heating in the region where it surrounds heater 14 and cartridge 18, heat being radiated from heater 14 through end 18 of cartridge 17 to section 20 of wire coil 19. Section 21 of wire coil 19 is heated by conduction of heat from section 20. A seal is created between the lip-shaped sealing edge 26 and the rod 16 passing therethrough. If gluing material which is still in a liquid state flows back from guide channel 15 of heater 14 into the guide channel 25 of cartridge 17, this liquid gluing material will not cool prematurely due to the presence of portion 21 of wire coil 19, which provides a certain amount of heating to the portion of the cartridge 17 surrounded by coil portion 21. Clearance gap 22 provided between coil portion 21 and cartridge 17 and which is preferably due to the provision of a reduction in the outer diameter of cartridge 17, enables the cartridge 17 to expand when gluing material flows back into the guide channel 25. Should the gluing material solidify due to the deenergization of heater 14, cartridge 17 will then engage coil portion 21 due to its diametric enlargement. When the heater 14 is reenergized, heat is directly transferred from coil portion 21 to cartridge 17 due to the surface engagement therebetween, causing even greater heating of the cartridge 17 and hence the gluing material rod 16 to soften the gluing material which has flowed back into cartridge 17, so that the rod 16 can be inserted without much difficulty into guide channel 15 of heater 14, together with a newly inserted rod or with the still present remaining portion of gluing material rod 16.

The lip-shaped circumferential sealing edge 26 provides a sealing separation between the guide channels 15 and 25 when the gluing material rod 16 is inserted. This seal is achieved for certain diameters of gluing material rods whose outer diameters are substantially equal to, or greater than, the inner diameter of sealing edge 26. In the event that the seal produced by the lip-shaped circumferential sealing edge 16 is insufficient due, for example, to a reduction in outer diameter of the rod 16 or due to the use of a rod whose outer diameter is smaller than the inner diameter of sealing edge 26, the operational impairment due to back flowing and previous softening of the gluing material which was unavoidable in conventional apparatus, is now avoided due to the transfer of heat through the metal sleeve 19 to at least a portion of the cartridge 17 removed from heater 14.

In the arrangement of the present invention, the outflow of gluing material between the end 18 of cartridge 17 and heater 14 is not possible, since the section 20 of metal wire coil 19 firmly holds the cartridge 17 in sealing engagement with heater 14.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A device for guiding a rod-shaped member formed of a gluing material which can be softened by heat when inserted into the guide channel of a heating means, said guide device comprising an elastic flexible cartridge having a hollow guideway extending therethrough;

one end of said guideway telescopingly receiving the entry end of said heating means and the other end of said guideway receiving said rod;

sleeve means having first and second sleeve portions surrounding said cartridge, said first portion securing said cartridge to said heating means and said second portion encircling at least a portion of said cartridge removed from said heating means;

said sleeve being formed of a material for conducting heat.

2. The device according to claim 1 wherein said cartridge is provided with an inwardly directed lip-shaped sealing edge for forming a seal between said edge and seal rod-shaped member when inserted therethrough for substantially eliminating the flow of liquid gluing material from said heating means to said cartridge.

3. The device according to claim 1 or 2 wherein an annular clearance space is provided between the interior periphery of the second sleeve portion surrounding said cartridge and the outer periphery of the cartridge encircled by said second sleeve portion.

4. The device according to claim 3 wherein at least the portion of said cartridge surrounded by said second sleeve portion is provided with a reduced outer diameter to form an annular-shaped clearance space between said sleeve second portion and the portion of said cartridge surrounded by said second sleeve portion.

5. The device of claim 4 wherein said sealing edge lies near one end of the reduced diameter portion of said cartridge.

6. The device of claim 2 wherein said circumferential sealing edge is joined to the guideway of said cartridge by an inwardly tapered surface extending from said guideway to said edge to facilitate guidance of said rod through the opening defined by said edge.

7. The device of claim 6 wherein the surface of said circumferential sealing edge facing said heating means forms a shoulder for limiting the insertion depth of said heating means into said cartridge.

8. The device according to claim 1 wherein said sleeve means comprises a wire coil.

9. The device according to claim 8 wherein said wire coil is a helically-wound wire coil.

10. The device according to claim 8 wherein the second sleeve portion is a metal coil provided with a winding forming a clearance space between said second sleeve portion and said cartridge whereas the first sleeve portion comprises a metal coil whose windings tightly engage the cartridge.

11. The device according to claim 1 wherein said cartridge guideway has a tapered conical shape to facilitate insertion of said rod through said guideway and into said heating means.

* * * * *